US007357533B2

(12) United States Patent
McDermott et al.

(10) Patent No.: US 7,357,533 B2
(45) Date of Patent: Apr. 15, 2008

(54) LIGHT-EMITTING DIODE LIGHTING DEVICE

(76) Inventors: Vernon C McDermott, 60-41 83rd St., Middle Village, NY (US) 11379; Vernon McDermott, Jr., 135 A Sand Point Rd., Sands Point, NY (US) 11050

( * ) Notice: Subject to any disclaimer, the term of this patent is extended or adjusted under 35 U.S.C. 154(b) by 0 days.

(21) Appl. No.: 11/408,554

(22) Filed: Apr. 20, 2006

(65) Prior Publication Data

US 2006/0239000 A1 Oct. 26, 2006

Related U.S. Application Data

(60) Provisional application No. 60/674,206, filed on Apr. 21, 2005.

(51) Int. Cl.
*F21V 19/02* (2006.01)

(52) U.S. Cl. ..... 362/285; 362/244; 362/800

(58) Field of Classification Search ..... 362/239, 362/240, 244, 246, 250, 285, 335, 337, 340, 362/418, 800

See application file for complete search history.

(56) References Cited

U.S. PATENT DOCUMENTS

| | | | | |
|---|---|---|---|---|
| 1,528,332 | A * | 3/1925 | Hemmeter et al. | 362/240 |
| 5,130,909 | A * | 7/1992 | Gross | 362/800 |
| 6,231,207 | B1 * | 5/2001 | Kennedy et al. | 362/239 |
| 6,325,525 | B1 * | 12/2001 | Camarota | 362/250 |
| 6,527,408 | B1 * | 3/2003 | Korenek, Jr. | 362/800 |
| 7,188,988 | B2 * | 3/2007 | Koganezawa | 362/616 |
| 2005/0201112 | A1 * | 9/2005 | Machi et al. | 362/800 |
| 2006/0120083 | A1 * | 6/2006 | Trojanowski et al. | 362/244 |

* cited by examiner

*Primary Examiner*—Y. My Quach-Lee
(74) *Attorney, Agent, or Firm*—Morgan & Finnegan LLP

(57) ABSTRACT

A lighting device having one or more pair of side-emitting light-emitting diodes arranged end-to-end, one "flipped" relative to the other, such that the beam spreads of the LEDs complement one another and increase the overall beam spread of the device, or instead the intensity of the beam about a narrow angle.

16 Claims, 6 Drawing Sheets

LIGHT-EMITTING DIODE LIGHTING DEVICE

RELATED APPLICATION

Priority in this application is claimed under 35 U.S.C. §119(e) to U.S. provisional application Ser. No. 60/674,206, filed Apr. 21, 2005, which is hereby incorporated by reference in its entirety.

BACKGROUND OF THE INVENTION

1. Field of the Invention

The present invention relates to a light-emitting diode configuration for lighting devices. Particularly, the present invention is directed to a lighting device utilizing the subject light-emitting diode configuration.

2. Description of Related Art

A variety of methods and systems for utilizing light-emitting diodes ("LEDs") for specialty lighting purposes have been developed. Generally, LEDs are used where low power consumption and/or long life are desirable. A drawback for traditional LEDs is their relatively wide beam spread that is most intense only in a small area, which is typically directed in a direction perpendicular to a plane on which the LED is mounted. While progress has been made in creating LEDs with narrower, more focusable beam spreads, they still do not approach the universal beam spread possible with conventional light sources, such as incandescent or fluorescent light sources.

For this reason, various configurations have been proposed to manipulate the light emitted from LEDs. However, these configurations often have some drawback making them undesirable. For example, some configurations utilize many LED elements to work around the wide, diffuse beam spread inherent with LEDs. Thus, increased size, excess heat output, and extra expense all become problems for device applicability, lifespan and marketability, respectively.

SUMMARY OF THE INVENTION

It is therefore an object of the invention to provide a novel LED configuration that uses a minimum number of LED elements arranged in a space-saving configuration still effective to deliver a required light output.

The purpose and advantages of the present invention will be set forth in and apparent from the description that follows. Additional advantages of the invention will be realized and attained by the methods and systems particularly pointed out in the written description, as well as from the appended drawings. It is to be understood that both the foregoing general description and the following detailed description are exemplary and are intended to provide further explanation of the subject invention.

To achieve these and other advantages and in accordance with the purpose of the invention, as embodied and broadly described, the invention includes a lighting device having a pair of side-emitting light-emitting diodes arranged head-to-head, that is, one "flipped" relative to the other, such that the beam spreads of the LEDs complement one another and increase the overall beam spread of the device.

Typically, side-emitting LEDs are effective between about +45 degrees and −20 degrees, relative to horizontal, but output light a full 360 degrees about a central axis. By mounting two side-emitting light-emitting diodes "head-to-head" the relatively narrow beam spreads of each LED complement the other, and result in a beam pattern that is relatively strong between about −45 degrees and +45 degrees. Such a beam spread provides an essentially ideal light source for use with a Fresnel lens. Naturally, as the basic LED components improve, greater beam spreads can be achieved. Accordingly, reference to any specific angles is for the purpose of example, though representative of the current state of art of side-emitting LED technology.

The lighting device, as described above, can be used alone or can be used in conjunction with various lenses and/or filters.

The lighting device can be used with multiple Fresnel lenses arranged around the lighting device or with a single cylindrical Fresnel lens. Alternatively, the lighting device can be used with a refracting Fresnel lens. When used with a refracting Fresnel lens, light output from the LEDs is diffused to an extent that any shadows that might be generated from structure supporting the lighting device are eliminated.

Additionally, the pair of LEDs can be touching one another or can be separated from one another. If touching, one LED unit can be supporting the other or they can both be supported by external structure. If supported separately, the relative position of the LEDs, to one another or to a lens, can be adjusted, and thus the beam pattern can be fine-tuned to meet different specifications. If supported together, the relative position of the LEDs to a lens can still be adjusted to achieve a desired beam pattern. Such adjustment can be achieved by supporting the LEDs by a threaded rod, for example or by another suitable mechanism.

BRIEF DESCRIPTION OF THE DRAWINGS

The accompanying drawings, which are incorporated in and constitute part of this specification, are included to illustrate and provide a further understanding of the invention. Together with the description, the drawings serve to explain the principles of the invention.

DETAILED DESCRIPTION OF THE PREFERRED EMBODIMENT

Reference will now be made in detail to the present preferred embodiments of the invention, examples of which are illustrated in the accompanying drawings. The devices presented herein may be used for general or specialty lighting purposes. The present invention is particularly suited for use in marine and aviation applications where a predetermined specified light output is necessary in order to enhance visibility of boats, ships, buoys, piers, runway edges, antennas, airplanes and the like, particularly at long distances. For the purposes of explanation and illustration, and not limitation, an exemplary embodiment of the subject lighting device, in accordance with the invention, is shown in FIG. 1 and is designated generally by reference number 100.

Figure 1:
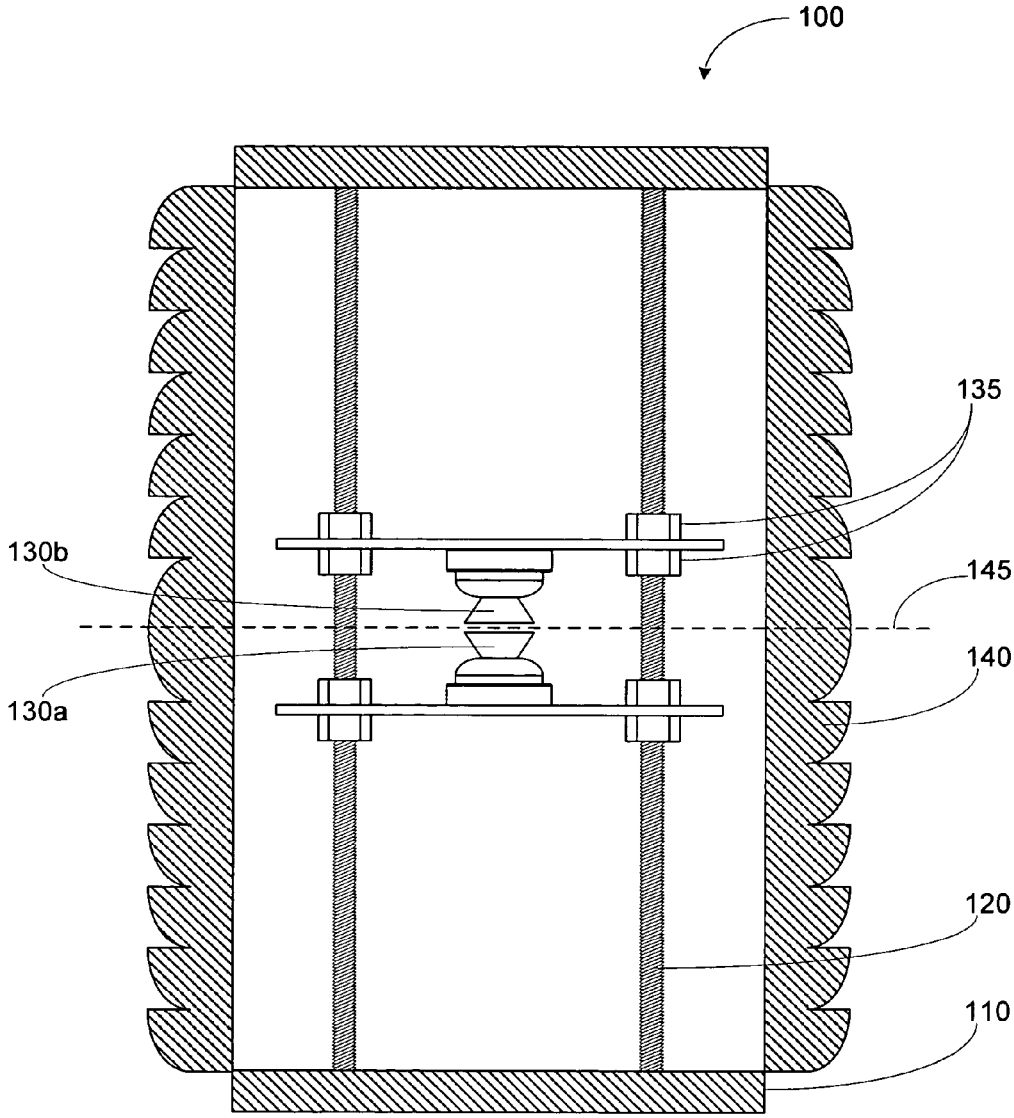
FIG. 1 is a partial cross-sectional view of one embodiment of the present invention.

As shown in FIG. 1, the system 100 generally includes a supporting base element 110, supporting a LED supporting structure 120, which in-turn supports LEDs 130*a*, 130*b*. Movable supporting elements 135 are attached to the LED supporting structure 120 to secure and provide adjustability to the lighting device, if so embodied. A lens 140 is arranged around the LED supporting structure 120 and LEDs 130*a*, 130*b*. The LEDs are preferably arranged around the central axis 145 of the lens 140 so as to provide light to the necessary location.

The LEDs 130*a*, 130*b* embodied herein are provided with adjustability, are not touching one another, and are provided with a cylindrical Fresnel lens. As described both above and below, these specific features can be substituted for others, depending on the effects and features desired.

With the LEDs 130*a*, 130*b* mounted in a symmetrical manner about a midline between the LEDs 130*a*, 130*b*, the relatively narrow, directional beam spread of each LED is compensated with an oppositely oriented beam spread, thereby providing a consistent and wider beam spread than would ordinarily be possible with conventional designs. Since in some side-emitting LEDs the most intense light is emitted between 45 above and about 20 degrees below horizontal, by positioning the side-emitting LEDs 130*a*, 130*b* end-to-end in the manner of FIG. 1 (and of FIG. 3 described below), the most intense light is output at an angle of about 45 degrees above the horizontal, very near a centerline of the lens, which is a preferred arrangement for use with a Fresnel lens.

Depending on the desired beam pattern, the LEDs 130*a,b* can be independently adjusted vertically, up or down. The movable supporting elements 135 can be, in a simplest embodiment, nuts engaged with a threaded rod support structure 120. Other suitable adjustment means would also be suitable.

Figure 2:
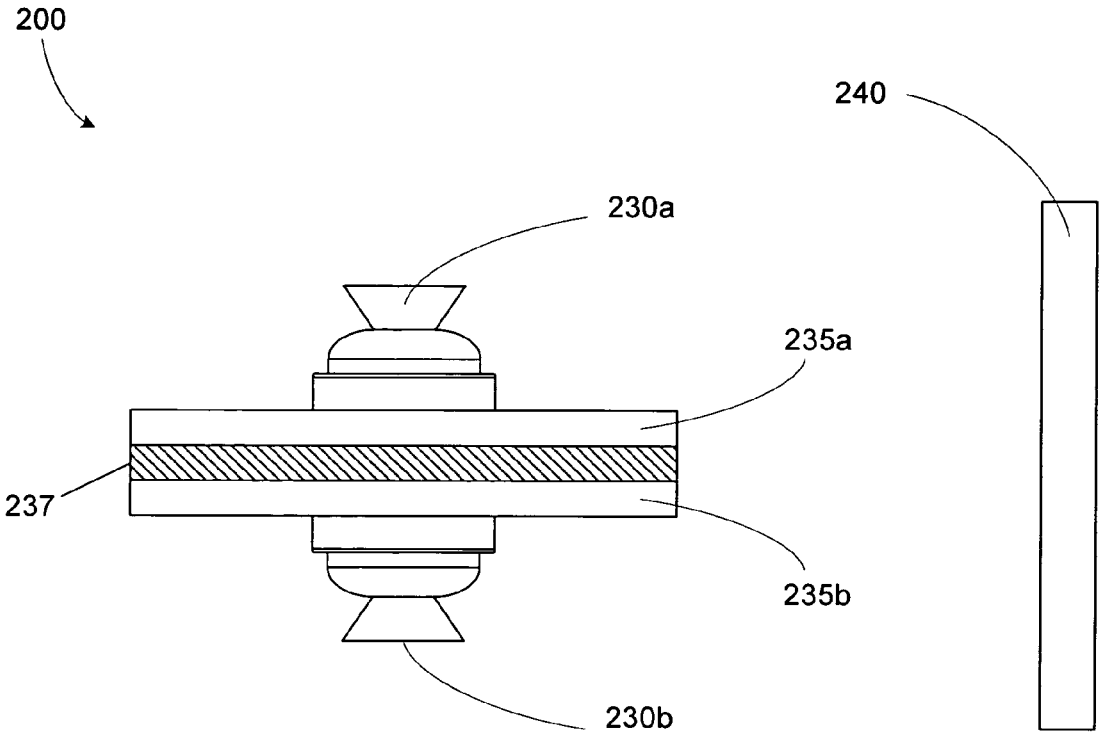
FIG. 2 is side view of a first alternate LED arrangement in accordance with the invention.

FIG. 2 illustrates an alternate embodiment 200 of a LED arrangement of the subject lighting device. In this embodiment, the LEDs are also arranged end-to-end, but in a manner that does not necessarily result in a complementary extension of beam spread, but may instead result in increased intensity of a center section of the beam pattern, depending on the relative positioning of the LEDs 230*a*, 230*b*. Also, depending on the specific beam pattern of the LEDs 230*a*, 230*b* used, the overall beam pattern of the combined unit 200 can be preselected. Arranged as shown in FIG. 2, a somewhat wider beam spread, directly from the LEDs 230*a*, 230*b*, may be achieved, as compared with the orientation of LEDs in FIG. 1. Depending on the light output desirable for certain applications, the appropriate optical system can be utilized. Such optical systems, may include a filter or lens 240, including Fresnel or cylindrical Fresnel lenses, clear filter, opaque filters, refracting filters or the like.

In this embodiment, the LEDs are each mounted to a substrate 235*a*, 235*b*. These substrates 235*a,b* are in-turn mounted to each other as shown in FIG. 2, Alternatively, they can be independently supported as shown in FIG. 1. Moreover, in either arrangement, the LEDs can be adjustable. With the embodiment of FIG. 2, space savings are achieved due to the close positioning of the LEDs 230*a*, 230*b*, which are mounted in this embodiment along a common support 237. This support maybe of a variety of types. Particularly desirable is an open type that allows air to circulate therethrough in order to cool the LEDs 230*a*, 230*b*. Though simple, this arrangement provides the benefits of compactness, economy and intensity of light without losing the benefits of 360-degree light output of side-emitting LEDs.

Figure 3:
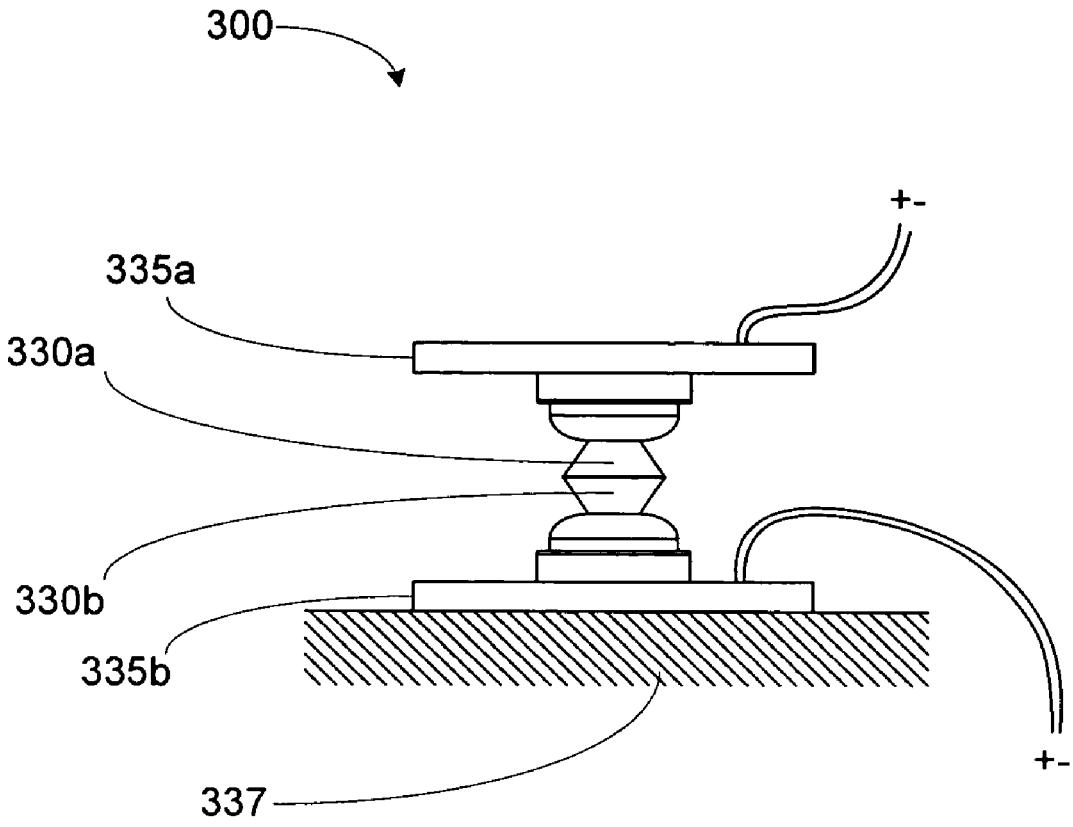
FIG. 3 is a side view of a second alternate LED arrangement in accordance with the invention.

FIG. 3 illustrates an alternative embodiment 300 for supporting LEDs 330*a*, 330*b* in accordance with the invention. The overall configuration of the LEDs is similar to the embodiment of FIG. 1. However, in this embodiment, the upper LED 330*a*, is supported by the lower LED 330*b*, which is in-turn supported by support element 337. Naturally, the support element 337 could be secured directly to the upper LED 330*a*, and the lower LED 330*b* could be attached thereto. The LED 330*a*, 330*b* can be attached by adhesive, through solvent welding, by an intermediate mechanical connector or other satisfactory means. Naturally, to whichever LED 330*a*, 330*b* the support element 337 is mounted, it can be provided with linear adjustability, as described above.

Figure 4:
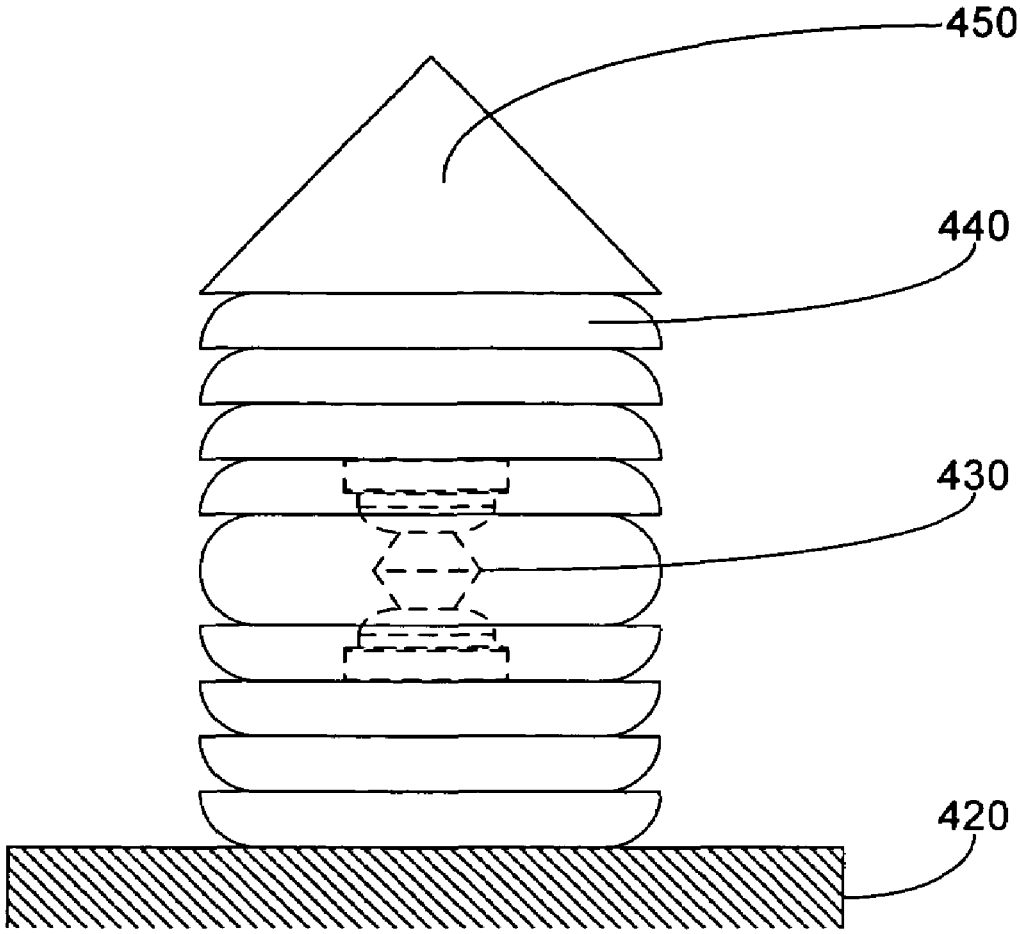
FIG. 4 is a side view of an example lighting device in accordance with the invention.

FIG. 4 is a side, external view of a lighting device of the present invention. In this embodiment, a single cylindrical Fresnel lens 440 is supported by base 420. A LED unit 430 is provided inside the cylindrical Fresnel lens 440. In this embodiment, an inclined lid 450 is placed atop the lens 440. Such lens may simply be to shed the elements, but may alternatively be provided with active features such as solar panels, photoelectric sensors and/or additional lights for other uses.

Figure 5:
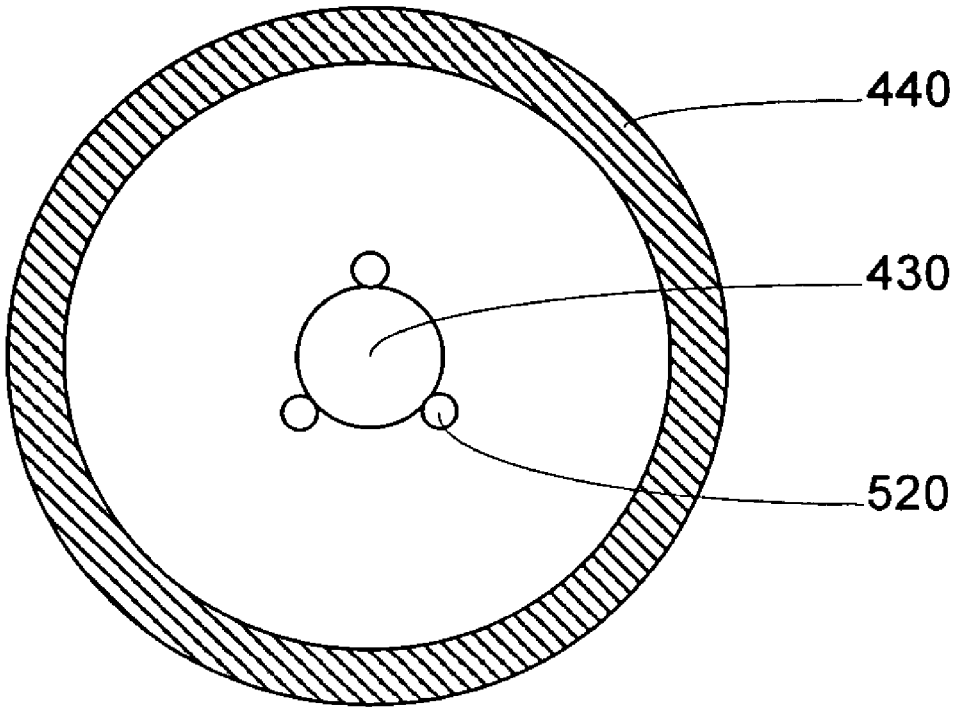
FIG. 5 is a top partial cross-sectional view of a lighting device according to the invention.

FIG. 5 is a top cross-sectional view of the embodiment of FIG. 4. This figure illustrates the cylindrical Fresnel lens 440, the LED unit 430 and a supporting structure 520 for the LEDs.

Figure 6:
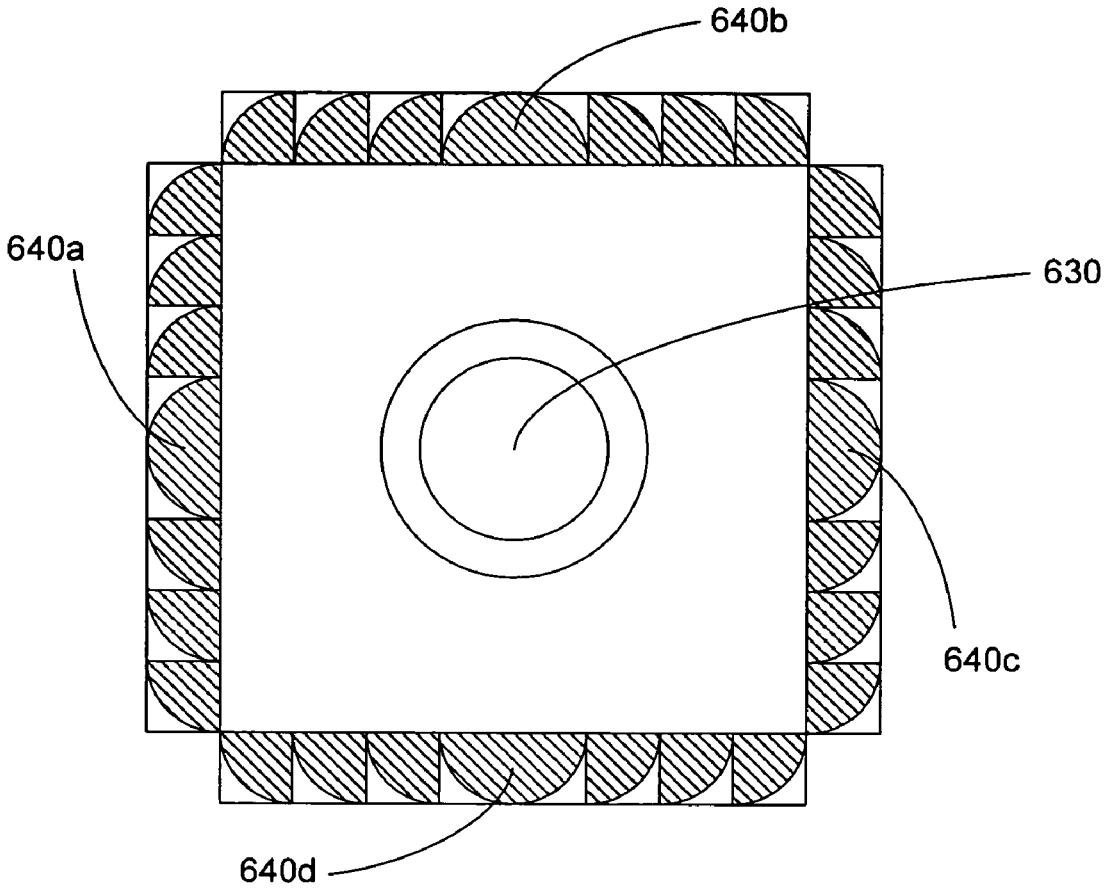
FIG. 6 is a top partial cross-sectional view of an alternate embodiment of a lighting device according to the invention.

FIG. 6 is a top view of a lighting device according to the present invention having an alternate lens arrangement. Multiple flat Fresnel lenses 640*a-d* are provided and mounted around the LEDs 630. In this embodiment, four Fresnel lenses 640*a-d* are provided in an essentially square cross-sectional arrangement. However, it is to be noted that any number of Fresnel or other types of lenses can be utilized with the subject invention. Of course, no lens need be utilized to experience benefits of the subject invention. For example, a clear cover may simply be provided to protect the LEDs from damage.

In general, lighting devices according to the present invention may be provided with a power system. Such system may simply include batteries, but may also include a charging circuit and a control circuit. The charging circuit can interface with an external source of power or an internal source of power, such as set of photovoltaic cells. A control circuit may in its simplest form be a switch triggered by an external force, such as a user. The switch may essentially be a light sensor that turns on the lighting device when ambient lighting conditions fall below a preset level. Other circuit elements may also be provided, depending on the desired effect. For example, the lighting device can be configured so as to blink instead of remaining steady.

The present invention, as described above and shown in the drawings, provides for a lighting device that is versatile, reliable, relatively inexpensive, compact and energy efficient.

It will be apparent to those skilled in the art that various modifications and variations can be made in the device of the present invention without departing from the spirit or scope of the invention.

What is claimed is:

1. A lighting device comprising:

two light-emitting diodes of a side-emitting type, arranged end-to-end along a common axis such that light output from each LED complements light output from the other LED to result in a wider beam pattern than each LED individually, wherein at least one of the two LEDs is adjustably mounted on a supporting structure along the common axis to adjustably position the LED.

2. The lighting device of claim 1, wherein a top end of a first LED is arranged along the axis facing a top end of a second LED.

3. The lighting device of claim 1, wherein a bottom end of a first LED is arranged along the axis facing a bottom end of a second LED.

4. The lighting device of claim 1 further comprising a lens mounted on the lighting device such that light emitted by the LEDs passes through the lens.

5. The lighting device of claim 4, wherein the lens is a Fresnel type lens.

6. The lighting device of claim 4, wherein the lens is a cylindrical Fresnel type lens.

7. The lighting device of claim 1, wherein a first LED is supported within the lighting device, a second LED being supported by the first LED.

8. The lighting device of claim 1, wherein the two light-emitting diodes are separated from one another.

9. The lighting device of claim 1, wherein the two light-emitting diodes are independently supported.

10. The lighting device of claim 1, wherein the two light-emitting diodes are supported together.

11. A lighting device comprising:

two side-emitting LEDs, mounted on a supporting structure, at least one side-emitting LED adjustable along the common axis on the supporting structure such that a top end of a first of the two side-emitting LEDs faces a top end of a second of the two side-emitting LEDs such that light output from each of the first and second side-emitting LEDs complements light output from the other of the first and second side-emitting LEDs to result in a wider beam pattern than each side-emitting LED individually, wherein the two side-emitting LEDs are adjustable between separation and contact with each other.

12. The lighting device of claim 11, further comprising a Fresnel lens mounted on the lighting device such that light emitted by the two side-emitting LEDs passes through the lens.

13. The lighting device of claim 12, wherein the Fresnel lens is a refracting Fresnel lens.

14. The lighting device of claim 11, further comprising at least three multiple flat Fresnel lenses mounted around the two side-emitting LEDs.

15. The lighting device of claim 11, further comprising four flat Fresnel lenses mounted around the two side-emitting LEDs.

16. A lighting device comprising:

two side-emitting LEDs arranged along a common axis such that a bottom end of a first of the two side-emitting LEDs faces a bottom end of a second of the two side-emitting LEDs;

a common support upon which the two side-emitting LEDs are mounted, wherein the two side-emitting LEDs are adjustable along the common axis on the common support and the common support is open such that air can circulate therethrough in order to coot the two side-emitting LEDs.

* * * * *